US005546361A

United States Patent [19]

Boucher et al.

[11] Patent Number: 5,546,361

[45] Date of Patent: Aug. 13, 1996

[54] DIRECTIONAL ELECTRO-ACOUSTIC TRANSDUCERS COMPRISING A SEALED SELL CONSISTING OF TWO PORTIONS

[75] Inventors: Didier Boucher; Charles Pohlenz, both of Six-Fours-Les-Plages, France

[73] Assignee: Etat Francais as represented by the Delegue General pour l'Armement, Paris, France

[21] Appl. No.: 360,944

[22] Filed: Apr. 28, 1989

[30] Foreign Application Priority Data

Apr. 28, 1988 [FR] France ..... 88.05660

[51] Int. Cl.[6] ..... H04R 17/00

[52] U.S. Cl. ..... 367/158; 367/159; 367/163; 367/174

[58] Field of Search ..... 367/141, 158, 367/159, 163, 174; 181/402, 104

[56] References Cited

U.S. PATENT DOCUMENTS 4,462,093 7/1984 Upton ..... 367/165

4,706,230 11/1987 Inoue et al. ..... 367/174

4,845,688 7/1989 Butler ..... 367/174

*Primary Examiner*—J. Woodrow Eldred

*Attorney, Agent, or Firm*—Oliff & Berridge

[57] ABSTRACT

The invention relates to directional electro-acoustic transducers comprising a sealed shell consisting of two portions.

A transducer according to the invention comprises one or more electro-acoustic drivers (1) composed for example of a stack of piezoelectric plates (1*a*, 1*b*, . . . 1*n*) located inside a sealed shell. This shell comprises a first portion (3A) symmetrical as to a plane (PP') fitted with two flanges at its ends, these flanges being coupled mechanically and acoustically by means of a rod (7) and two bolts (8) With each driver (1). The shell includes a second portion (3*b*) which is complementary to the first portion and which is acoustically uncoupled from the first portion and from the drivers.

An application of the invention is the construction of low-frequency transmitter of acoustic waves in the water in a given direction.

8 Claims, 4 Drawing Sheets

DIRECTIONAL ELECTRO-ACOUSTIC TRANSDUCERS COMPRISING A SEALED SELL CONSISTING OF TWO PORTIONS

The present invention relates to electro-acoustic transducers of the type referred to as flextensional, which comprise a sealed shell containing one or more electro-acoustic drivers.

The technical sector of the invention is that of submarine acoustics.

Known in the prior art are electro-acoustic transducers referred to as flextensional, comprising one or more electro-acoustic drivers, usually piezoelectric drivers, which are located inside a sealed and flexible envelope or shell.

These transducers are used in particular for transmitting in the water low-frequency acoustic waves on the order of 1 KHz and, in that case, the sealed shell is in contact with the water and constitutes the surface which transmits acoustic waves in the water.

These transducers convert the oscillations in the axial direction of expansion-compression of the piezoelectric drivers into shell bending oscillations, hence their name of flextensional. They permit to amplify the oscillation amplitude.

It must be kept in mind that conventional flextensional transducers fall into four classes, depending on the general shape of the shell.

Class I corresponds to transducers having an ovoidal shell generated by revolution about an axis, and a single electro-acoustic driver, which can be either a piezoelectric or a magnetostrictive driver, which is coaxial with the shell and which is coupled mechanically and acoustically at its both ends with the two areas of the shell located on the axis of revolution.

Class II corresponds to transducers with a shell in the form of a disk or a torus generated by revolution around the disk or torus axis. These transducers comprise a plurality of piezoelectric drivers disposed radially around the axis and coupled mechanically and acoustically with the shell at their ends.

Class III corresponds to transducers with a shell showing two bulges at its both ends, and in the general shape of a bone or a twinned-wheel.

Class IV corresponds to tranducers with a shell in the form of a cylindrical chimney the cross-section of which is in the form of an ellipse or a closed curve showing a throat in its central portion.

Class IV transducers comprise a plurality of piezoacoustic drivers parallel to one another the axes of which are located in transverse planes perpendicular to the generatrices of the chimney and both ends of each driver are coupled mechanically and acoustically with the cylindrical shell.

The present invention relates more particularly but not exclusively to class IV flextensional transducers.

Flextensional transducers present numerous advantages but they also present some disadvantages.

As the shell is a transmitting surface which has a symmetry of revolution or a symmetry as to two perpendicular planes, in the case of a cylindrical shell, these transducers are multidirectional or bidirectional, which is not suitable for the applications requiring a transmission in a single direction which may be fixed or space-scanning.

The problem to be solved consists in building transducers which present the, advantages of the known flextensional transducers and which make it possible to transmit in a given direction without it being necessary to associate them with reflectors located behind the transducer and without it being necessary to use two rows of transducers transmitting with a phase-shift close to 90° in order to produce interferences.

Electro-acoustic transducers according to the invention are of the known type comprising at least one electro-acoustic driver,located inside a sealed shell, which is in contact with a liquid and serves as a surface which transmits acoustic waves in the said liquid.

The aim of the invention is met by means of a transducer in which the said shell comprises a first portion of flexible shell with two flanges at its both axial ends, which are coupled mechanically and acoustically with the axial ends of said piezoelectric drivers, that first portion of shell constituting a surface which transmits acoustic waves and including a second portion of shell which complements the first portion with which it forms the said sealed shell, that second portion of shell being uncoupled acoustically from the said first portion and said electro-acoustic drivers.

According to a first mode of embodiment, each electro-acoustic driver comprises a stack of co-axial piezoelectric plates, located between two counter-masses, determined so that the fundamental frequency of the axial oscillations of each mechanical assembly constituted by a driver and its two counter-masses will be close to the natural frequency of the bending oscillations of the said first portion of shell, those counter-masses being coupled mechanically and acoustically with said electro-acoustic drivers and said flanges of said first portion of shell.

Advantageously, the counter-masses are determined for the fundamental frequency of the axial oscillations of each mechanical assembly comprising a driver and its two counter-masses to be slightly lower than the natural frequency of the bending oscillations of the said first portion of shell.

According to another mode of embodiment, a transducer according to the invention comprises one or more pairs of electro-acoustic drivers, each pair being composed of two identical drivers excited in the phase-shift mode.

In the case of a shell in the form of a cylindrical chimney with a cross-section roughly elliptical and a longitudinal symmetry plane (x x') containing the major axes of the elliptical sections of the shell, a mode of embodiment of a transducer according to the invention comprises a plurality of pairs of electro-acoustic drivers, each pair including two identical drivers the axes of which are parallel to the said longitudinal symmetry plane and are symmetrical as to the said plane.

In the case of a shell in the form of a cylindrical chimney with an elliptical cross-section and a longitudinal symmetry plane (P P') containing the minor axes of the elliptical sections of the shell, another mode of embodiment of a transducer according to the invention comprises a plurality of pairs of electro-acoustic drivers, each pair including two identical electro-acoustic drivers parallel to each other and each driver consists of two half-drivers forming a V symmetrical as to the said longitudinal symmetry plane passing through the minor axis of the ellipse.

The invention results in new electro-acoustic transducers of the flextensional type, wherein the sealed shell comprises a transmitting portion coupled mechanically and acoustically with the ends of the electro-acoustic drivers and which is flexible, so that it converts the axial oscillations of the piezoelectric drivers into bending oscillations and that it transmits in a privileged direction which corresponds to the maximum amplitude of bending oscillations, e.g. the direction of the minor axes of the ellipses when the portion of transmitting shell has the shape of a portion of ellipse symmetrical as to the minor axis and fitted at its both ends with two flanges parallel to the minor axis, which are coupled acoustically with both ends of each electro-acoustic driver.

The second portion of shell is uncoupled mechanically and acoustically form the first portion and from the piezo-electric drivers so that it does not vibrate. Its only function is to supplement the first one so as to form with it a sealed shell or a support of a sealed envelope which contains the two portions of shell.

The mode of embodiment in which each driver comprises a stack of piezoelectric plates located between two counter-masses makes it possible to lower the fundamental frequency of the axial oscillations of each mechanical assembly composed of a stack of plates and two counter-masses so as to obtain a frequency slightly lower than the natural frequency of the bending oscillations of the first portion of shell, which makes it possible to build low-frequency transducers having a wider pass-band than that of known flextensional transducers and having a good directivity.

The presence of the two counter-masses at both ends of each stock of piezoelectric plates permits to obtain a good electro-acoustic coupling between the drivers and the portion of transmitting shell and also permits to cause the piezoelectric drivers to operate at a frequency close to their resonance frequency in mode 1, i.e. in the axial expansion-compression mode.

The following description refers to the attached drawings which represent, without any limiting character, general examples of embodiment of transducers according to the invention.

The transducers according to the invention are electro-acoustic transducers used as low-frequency transmitters in the water, using the principle of the so-called flextensional transducers, which comprise one or more electro-acoustic drivers, usually composed of a stack of piezoelectric ceramics, located inside a flexible shell, and which convert the oscillating motions of expansion-compression in the axial direction of the piezoelectric drivers into bending motions of the shell having an amplified displacement amplitude.

The flextensional transducers known to date comprise a sealed flexible shell which has a symmetry either of revolution about an axis or as to a plane.

For that reason, these transducers are multidirectional or bidirectional and if a directional transmission is desired, it is necessary to absorb or reflect the acoustic waves transmitted by the transducer towards other directions than the selected direction.

Until now, it has been necessary to use either a reflector located behind the transducers, or two rows of identical and parallel transducers separated by a distance which is close to a quarter of the wave-length, and transmitting with a phase shift close to 90°, which leads, theoretically, to interferences between transmitting waves. These solutions are cumbersome and costly.

The transducers according to the invention provide another solution for obtaining a directional transmission without resorting to auxiliary devices.

This solution consists in using a first portion of non-symmetrical transmitting shell which transmits preferably in a given direction and supplementing this first portion with a second portion which is not coupled symmetrically with the piezo-electric driver (s) and the only function of which is to provide for the box tightness.

Figure 1:
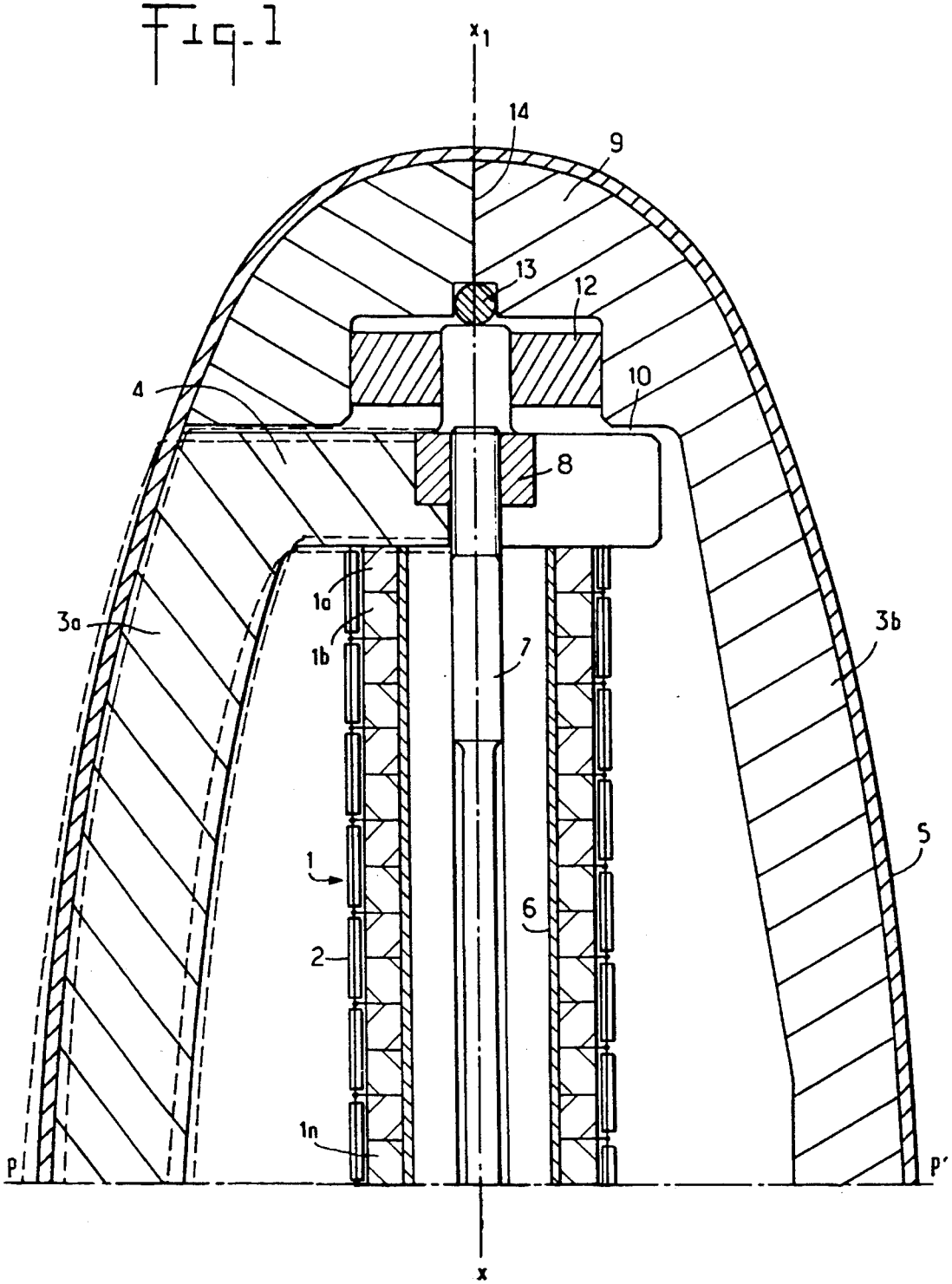
FIG. 1 is a half-cross-sectional view of a first mode of embodiment of a transducer according to the invention.

FIG. 1 shows a first mode of embodiment.

Datum marke 1 represents an electro-acoustic driver comprising a stack of rings 1*a*, 1*b*, . . . 1*n* with an axis x x1 of piezo-electric ceramic between which electrodes are inserted, connected by electric conductors 2 to an electronic transmitter not shown, which excites the ceramics and makes them oscillate in expansion-compression about the axis x x1.

This figure is a half cross sectional view, limited by a symmetry plane PP' perpendicular to the axis x x1.

It represents either an axial cross-section of a transducer generated by revolution about the axis x x 1 and including a single stack of ceramics, or a transverse cross-section of a transducer in the form of a cylindrical chimney the generatrices of which are parallel to a symmetry plane x x1 and, in that case, the transducer includes a plurality of parallel and identical piezo-electric drivers the axes x x1 of which are in the symmetry plane.

The transducer according to FIG. 1 comprises a sealed shell composed of two portions, a portion 3 a which is flexible and includes two ends 4 coupled mechanically and acoustically with the ends of the drivers (s) 1, so that the axial oscillations of the driver 1 are converted into bending oscillations represented by a dotted line in order to show that the amplitude of bending oscillations is maximum in the plane PP1 and considerably amplified with regard to axial oscillations, so that the transducer is directional in a direction included in the plane PP1, on the same side as the transmitting half-shell 3*a*.

The first portion of shell 3*a* is made, for example, of an aluminium alloy.

FIG. 1 shows a preferred mode of embodiment in which the portion of shell 3*a* presents a curved centre section with an inward concavity, a relatively large radius of curvature, and symmetrical as to a plane PP' perpendicular to the axes x x' of the drivers.

For example, the portion 3*a* is a portion of ellipse with a major axis included in the symmetry plane PP'. This first portion comprises, at each of its both ends, a flat flange 4 directed towards the concavity.

The two flanges 4 are substantially parallel and symmetrical as to the plane PP'. Therefore, they are perpendicular or substantially perpendicular to the axes x x' of the drivers 1. The two flanges 4 are respectively coupled mechanically and acoustically with each of both ends of the drivers 1.

The sealed box includes a second portion 3*b* which supplements the transmitting half-shell 3*a*, and the assembly formed by the two half-shells 3*a* et 3*b* is contained in a sealed envelope 5 which assumes the external shape of the two portions 3*a* and 3*b*, the outer faces of which are in line.

The ceramic rings 1*a*, 1*b*, . . . 1*n* are disposed around a tube 6, which is for example made of polyethylene.

A metal rod 7 is disposed coaxially inside the tube 6. The rod 7 crosses the two flanges 4. It comprises two threaded ends on which two nuts 8 are screwed, resting on the flanges 4. Tightening the nuts results in the tension of the rods and keeps the flanges 4 in close contact with both ends of the driver (s) 1, which results in the mechanical and acoustic coupling between the half shell 3*a* and the electro-acoustic drivers.

The half-shell 3*b* comprises a central section which is substantially symmetrical as to the plane x x1 of the central section of the half-shell 3*a* and which presents a slight curvature and, furthermore, it comprises at each of its both ends, a dome-shaped section with a greater curvature.

Each of the domes 9 is separated from the flange 4 located at the same end by a gap 10, so that there is no acoustic coupling between the half-shell 3*a* and the half-shell 3*b*.

FIG. 1 shows a mode of embodiment in which the domes 9 are composed of two sections separated by a mating face blended with the plane x x'. As a variant, the domes 9 may be made of a single piece.

In the mode of embodiment according to FIG. 1, the flanges 4 includes an axial part 11 which is cut out for the passage of the rods 7 and the bolts 8 and connected to the domes 9 by means of uncoupling buffers made of an elastomer material Two rings 13 made of an elastomer material are placed in two grooves 14 recessed in the inner face of the domes 9 and the ends of the axial part 11 rest on these two rings.

The elastic buffers 12 and the rings 13 provide for a correct axial and longitudinal centring of the two half-shells 3*a* with regard to the half-ring 3*b*, while acoustically uncoupling the half-shells 3*a* and 3*b*.

The tests conducted using transducers according to FIG. 1 have shown that these transducers are unidirectional.

On the contrary, the electro-acoustic coupling between the transmitting half-shell 3*a* and the electro-acoustic driver(s) 1 is extremely slight, on the order of 2 to 5%.

This is due to the fact that the transmitting frequency is the natural frequency of the bending oscillations of the half-shell 3*a* which is much lower than the fundamental frequency of the axial oscillations of the drivers, so that the latter vibrate under conditions which are very for from resonance, hence a bad efficiency, and they also have a much pronounced and ill-coupled bending motion.

On the other hand, the acoustic and mechanical uncoupling between the drivers and the non-transmitting half-shell 3*b* entails an asymmetry of the mechanical stresses brought to bear on the stack of ceramics and, consequently, this asymmetry results in bending distorsions of this stack, bringing about a mechanical fatigue of the ceramics and energy losses.

Figure 2:
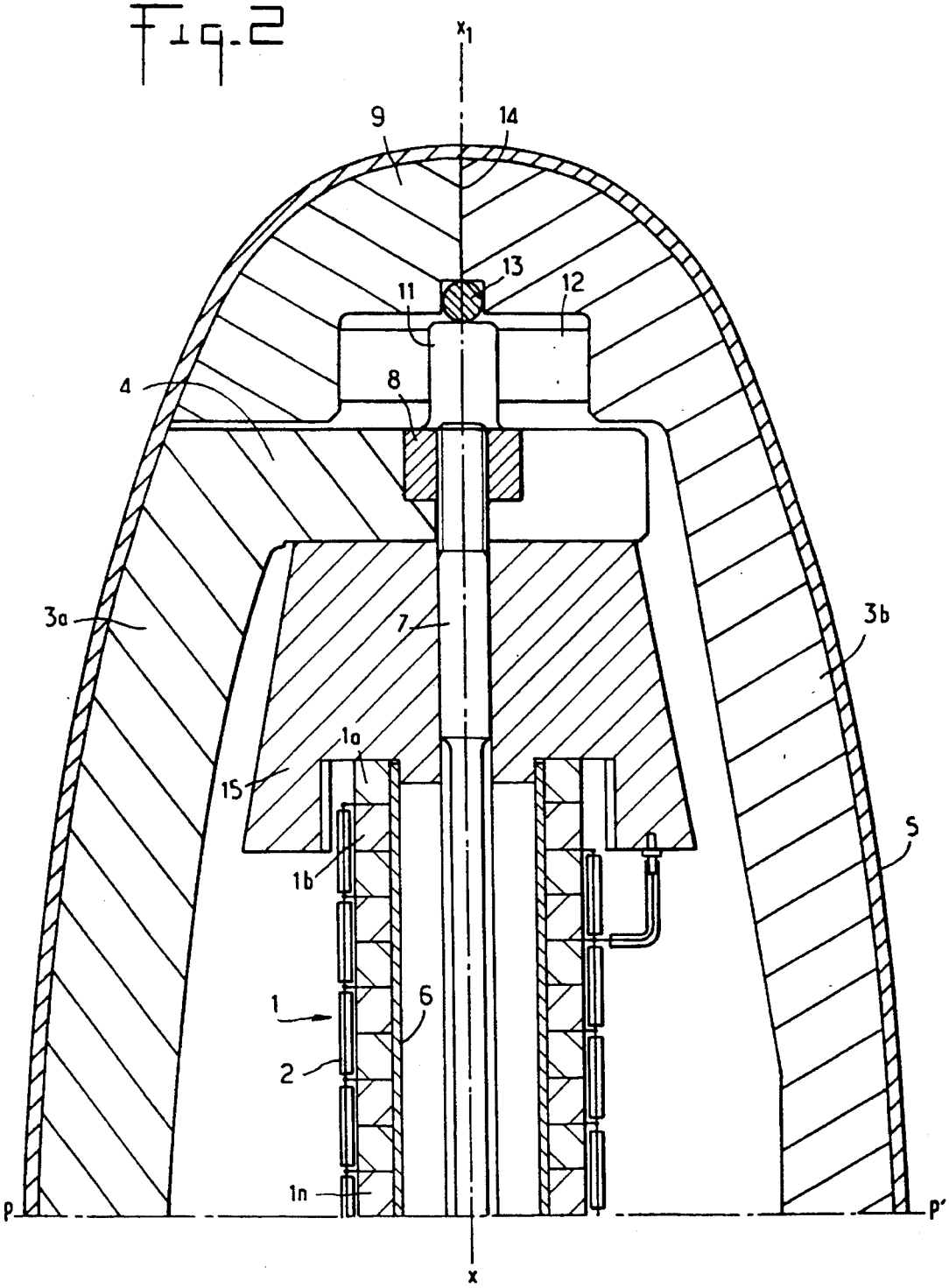
FIG. 2 is a half-cross-sectional view of a second mode of embodiment of a transducer according to the invention.

FIG. 2. is a half-cross sectional view of an other mode of embodiment of a transducer according to the invention. Like the previous one, this transducer is asymmetrical as to the plane PP'.

The homologous parts are represented by the same datum marks on FIGS. 1 and 2.

The transducer according to FIG. 2 differs from the transducer according to FIG. 1 by the fact that it includes two counter-masses 15 located at both ends of each stack of piezoelectric plates 1*a*, 1*b*, . . . 1*n*.

These counter-masses, which vibrate simultaneously with the piezoelectric plates, are intended to reduce the natural frequency of the stack. They can be calculated so as to obtain a given natural frequency and they are calculated so that the natural frequency of the vibrating assembly consisting of each stack and the two counter-masses will be close and, in preference, slightly higher than the natural frequency of the bending vibrations of the half-shell 3*a*.

As can be seen on FIG. 2, the counter-masses 15 include a axial hole for the passage of the rod 7 which has two threaded ends on which two nuts 8 are screwed and rest on the flanges 4 of the shell 3*a*. Tightening the nuts results in the tension of the rod 7 and its tension provides for the mechanical and acoustic coupling between the flanges 4 at the end of the shell 3*a*, the counter-masses 15 and the stack 1 of piezoelectric plates.

Measurements taken using a transducer according to FIG. 2 show that the coefficient of coupling between the stacks and the transmitting shell 3*a* so obtained is on the order of 40%. The addition of two counter-masses at both ends of each piezoelectric drivers makes it possible to widen the pass-band towards low and high frequencies, selecting counter-masses such that the natural frequency of the axial vibrations of the assembly formed by each stack and its two counter-masses will be slightly higher than the natural frequency of the bending vibrations of the transmitting half-shell 3*a*.

This leads also as a substantial reduction of the bending distorsions of the stacks because the latter are caused to vibrate in elongation-compression at a frequency close to their resonance frequency and the most part of the power is transformed into elongation-compression vibrations parallel to the axis x x1.

Figure 3:
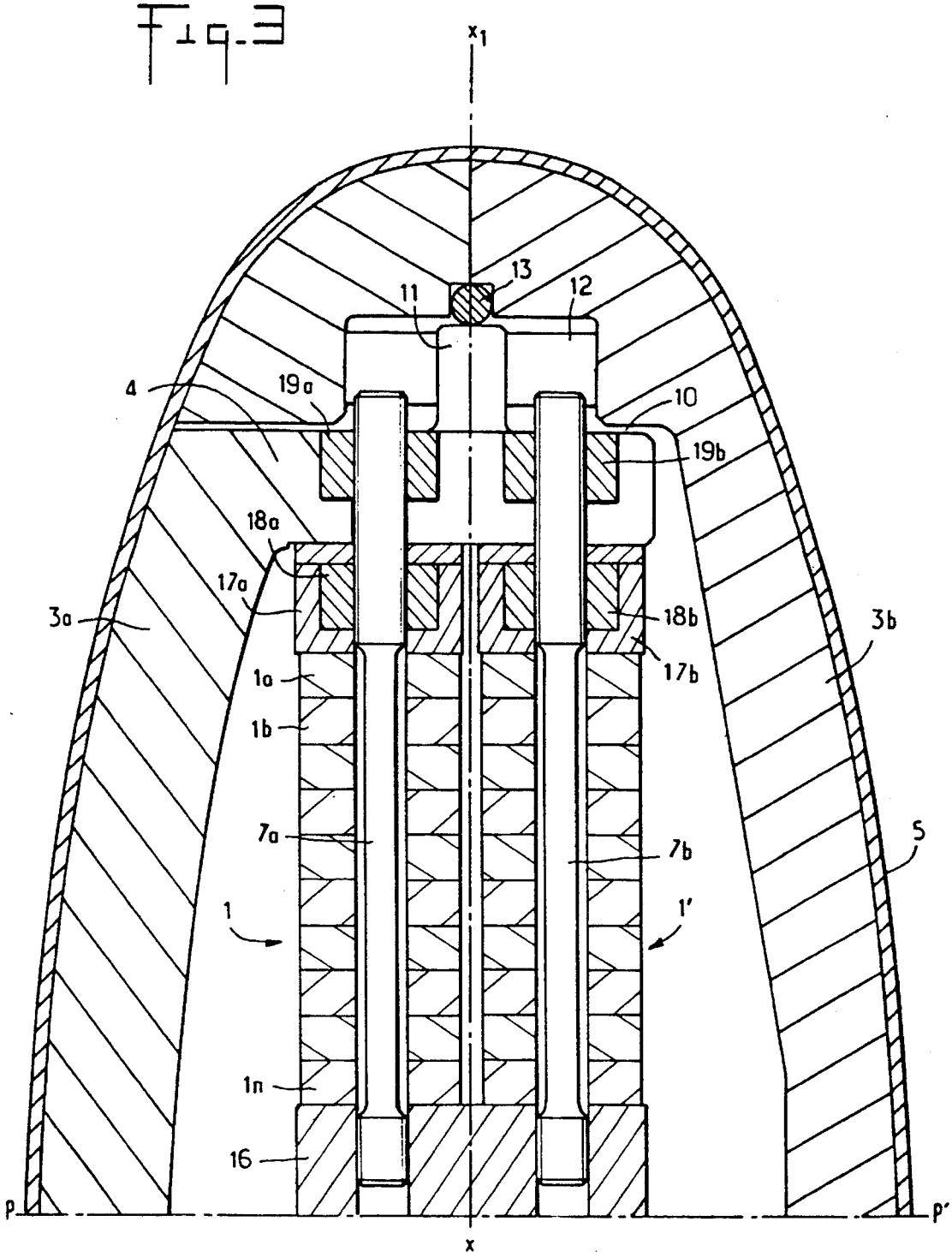
FIG. 3 is a half-cross-sectional view of a third mode of embodiment of a transducer according to the invention.

FIG. 3. is a half-cross-sectional view of another mode of embodiment of a flextensional transducer according to the invention, symmetrical as to the plane PP'.

The homologous parts are represented by the same datum marks on FIGS. 1 to 3.

The transducers according to FIG. 3 have the shape of chimneys the generatrices of which are perpendicular to the plane of the figure. This mode of embodiment comprises several pairs of stacks (1) of piezoelectric ceramics. Each pair consists of two identical stacks of ceramics 1*a*, 1*b*, . . . 1*n*, symmetrical as to a plane perpendicular to the plane of the figure and passing through the axis x x' which is a symmetry plane for the assembly composed of the two shells 3*a* and 3*b*. Each stack comprises an axial rod 7*a*, 7*b* which crosses all the plates. FIG. 3 shows a mode of embodiment wherein each pair of stacks includes a central block 16 and each stack is divided into two half-stacks symmetrical as to the plane PP'.

As a variant, the central block 16 may be suppressed.

Each rod 7*a*, 7*b* has threaded ends which successively cross a nut cup 17*a*, 17*b* , which accommodates a first nut 18*a*, 18*b*, and then one of the flanges 4 of the transmitting half-shell 3*a*.

Tightening the first bolts 18*a*, 18*b* provides for the mechanical and acoustic coupling between the stack plates and the rod 7*a* or 7*b*. A second nut 19*a*, 19*b* is screwed ont the threaded end of each rod 7*a*, 7*b* and it rests on the flange 4, thus ensuring the mechanical and acoustic coupling between the two piezoelectric drivers and the flanges 4 of the transmitting half-shell 3*a*.

In this mode of embodiment, the two stacks 1 and 1' of piezoelectric plates are excited in opposition of phase, which results in the creation of bending oscillations of each pair of stacks.

These bending oscillations drive the flanges 4 located at both ends of the transmitting half-shell. The two flanges 4 are subjected to two torques of opposite directions which oscillate alternately in one direction and in the other and these torques bring about bending oscillations of the half-shell 3*a*, with a maximum amplitude in the symmetry plane PP'.

Figure 4:
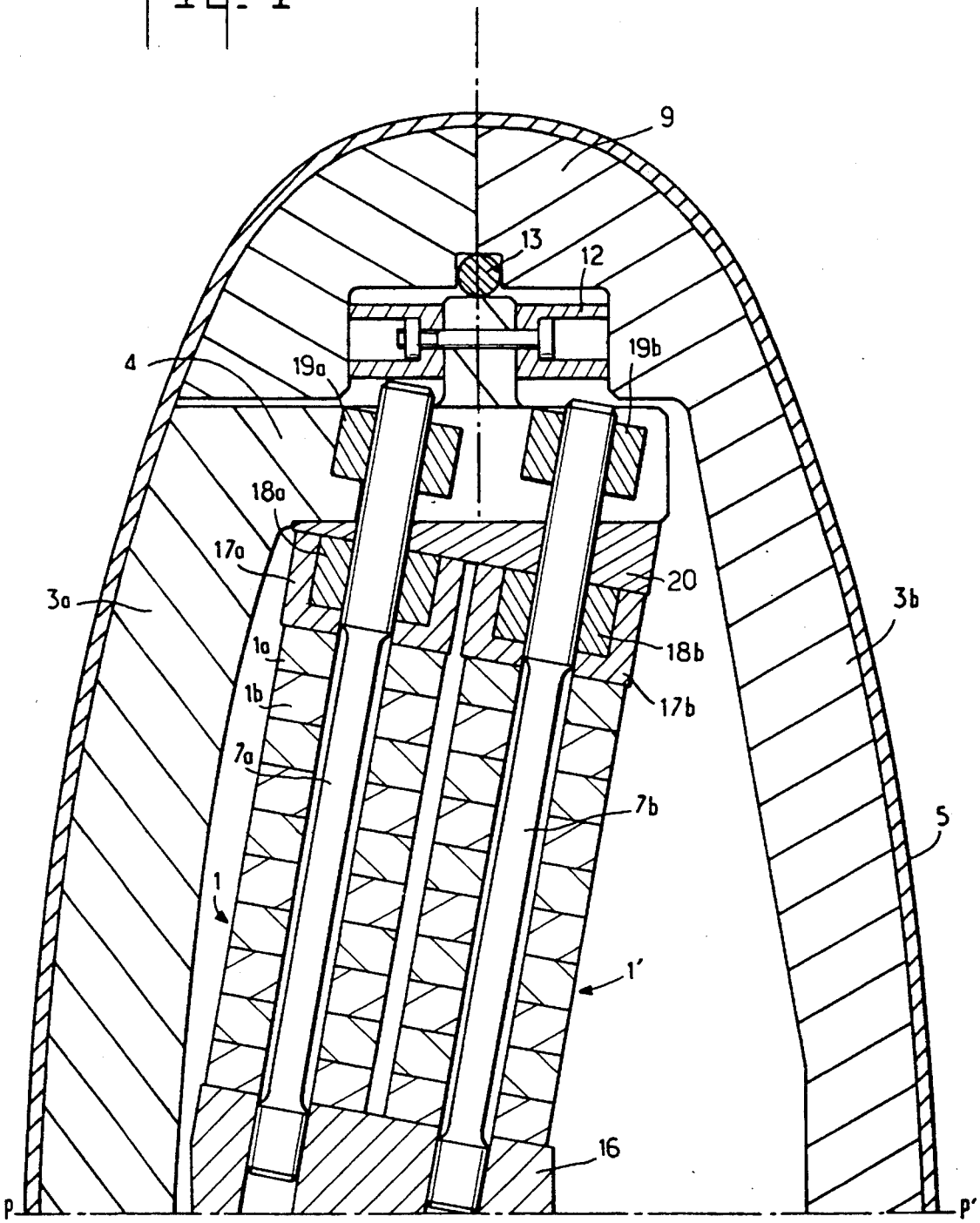
FIG. 4 is a half-cross-sectional view of a fourth mode of embodiment of a transducer according to the invention.

FIG. 4 is a half-sectional view of another mode of embodiment of a flextensional transducer according to the invention.

As in the mode of embodiment according to FIG. 3, the transducer according to FIG. 4 comprises several pairs of stacks and each stack is composed of two half-stacks separated by a central, block 16 and symmetrical as to the plane PP'. The only difference is that the two half-stacks symmetrical as to the plane PP' are not in line. They form an angle with the plane PP'.

The central block 16 has the shape of a corner the external faces of which are perpendicular to the rods 7*a* and 7*b*. Another corner 16 with an apex angle complementary of the half apex angle of the corner 16 is inserted between the ends of each pair of stacks and each flange 4.

This mode of embodiment permits to obtain bending oscillations of the transmitting half-shell 3*a* with a greater amplitude.

We claim:

1. An electro-acoustic transducer of the type comprising at least one electro-acoustic driver, located inside a sealed shell, which is in contact with a liquid, characterized in that said shell comprises a first portion of flexible shell fitted with two flanges at its axial ends, which are coupled mechanically and acoustically with the axial ends of said piezoelectric drivers, said first portion of shell constituting a surface which transmits acoustic waves and including a second portion of shell which supplements the first portion with which it forms said sealed shell, said second portion being acoustically uncoupled from said first portion and said electro-acoustic drivers.

2. A transducer according to claim 1, characterized in that said first portion of shell comprises a central flexible area having a concavity directed inwardly and a slight curvature which is symmetrical as to a plane perpendicular to the axes of said piezoelectric drivers and furthermore comprises two plane flanges secured to both ends of said central area, said flanges being symmetrical as to said symmetry plane and placed on the side of the concavity and respectively coupled mechanically and acoustically with each of both ends of said electro-acoustic drivers.

3. An electro-acoustic transducer according to claim 1, characterized in that each of said electro-acoustic drivers comprises a stack of coaxial piezoelectric plates located between two counter-masses, said counter-masses being determined so that the fundamental frequency of the axial oscillations of each mechanical assembly consisting in a driver and its two counter-masses will be close to the natural frequency of the bending oscillations of said first portion of shell, said counter-masses being coupled mechanically and acoustically with said electro-acoustic drivers and said flanges of said first portion of shell.

4. A transducer according to claim 3, characterized in that said counter-masses are determined so that the fundamental frequency of the axial oscillations of each mechanical assembly consisting of a driver and its two counter-masses will be slightly higher than the natural frequency of the bending oscillations of said first portion of shell.

5. An electro-acoustic transducer according to claim 1, characterized in that it comprises one or more pairs of electro-acoustic drivers, each pair being composed of two identical drivers which are excited in opposition of phase.

6. An electro-acoustic transducer according to claim 1, wherein said shell has the shape of a cylindrical chimney having an elliptical cross-section and a longitudinal symmetry plane containing the major axes of said elliptical cross-sections, characterized in that it includes a plurality of pairs of electro-acoustic drivers, each pair comprising two identical drivers the axes of which are parallel to said longitudinal symmetry plane and are symmetrical as to said plane.

7. An electro-acoustic transducer according to claim 1, wherein said shell has the shape of a cylindrical chimney having and elliptical cross section and a longitudinal symmetry plane containing the minor axes of said elliptical cross-sections, characterized in that it includes a plurality of pairs of electro-acoustic drivers, each pair comprising two identical electro-acoustic drivers parallel to each other and each driver comprises two half-drivers forming a V symmetrical as tot the said longitudinal symmetry plane passing through the minor axis of the ellipse.

8. A transducer according to claim 7, characterized in that each pair of piezoelectric drivers comprises a central part having the shape of a corner having two side faces converging towards each other and symmetrical as to said longitudinal plane and furthermore comprises two corner-shaped blocks located at both ends of the stacks, which have a shape complementary to said central part and which are respectively inserted between each end of both stacks and one of both flanges at the end of said first portion of shell and which are coupled acoustically and mechanically with said stacks and said flanges.

* * * * *